United States Patent [19]

Morgan

[11] Patent Number: 4,927,279

[45] Date of Patent: May 22, 1990

[54] KEYBOARDS FOR HOMES

[76] Inventor: Ruth B. Morgan, 737 N. Nelson St., #28, Arlington, Va. 22203

[21] Appl. No.: 405,592

[22] Filed: Sep. 11, 1989

Related U.S. Application Data

[63] Continuation of Ser. No. 589,412, Mar. 14, 1984, abandoned.

[51] Int. Cl.[5] ..... B41J 5/10

[52] U.S. Cl. ..... 400/486; 400/489

[58] Field of Search ..... 400/472, 473, 474, 486, 400/487, 483, 489

[56] References Cited

U.S. PATENT DOCUMENTS

| | | | |
|---|---|---|---|
| 185,714 | 12/1876 | Allen | 400/486 X |
| 761,179 | 5/1904 | Pilsatneeks | 400/474 |
| 1,292,319 | 1/1919 | Hooper, Jr. | 400/472 X |
| 1,336,151 | 4/1920 | O'Connor | 400/489 X |
| 1,506,426 | 8/1924 | Hoke | 400/486 |
| 2,040,248 | 5/1936 | Dvorak et al. | 400/486 |
| 2,080,457 | 5/1937 | Bower | 400/486 |
| 3,967,273 | 6/1976 | Knowlton | 400/486 X |
| 3,970,185 | 7/1976 | Shelton | 400/486 X |

FOREIGN PATENT DOCUMENTS

| | | | |
|---|---|---|---|
| 0194331 | 5/1907 | Fed. Rep. of Germany | 400/486 |
| 0336698 | 3/1905 | France | 400/486 |
| 0808874 | 9/1950 | United Kingdom | 400/486 |
| 0698327 | 10/1953 | United Kingdom | 400/473 |
| 2041295 | 9/1980 | United Kingdom | 400/489 |

OTHER PUBLICATIONS

IBM Tech. Disc. Bulletin, "Phonetic/Grammatic Keyboard Device"; Ludeman, C. P., vol. 19, No. 8, Jan. 1977, pp. 2860–2864.

*Primary Examiner*—Edgar S. Burr
*Assistant Examiner*—Ren Yan
*Attorney, Agent, or Firm*—Lowe, Price, LeBlanc, Becker & Shur

[57] ABSTRACT

Keyboards structured to accommodate electronic technology advances evidenced this past seven years involving keyboards for personal and home use on computers typewriters, personal home computers, calculator and chording keyboards and other typographical equipment are disclosed. A plurality of different designs utilize 26 letters of the English alphabet in a keyboard configuration of at least two rows and an unlimited number of keys. The vowels are separated from the consonants and placed on different rows; thereafter, vowels and punctuation appear on the same row completing one design. In some of the keyboards of the invention all of the vowels are separated from the consonants and in others only a few vowels are separated from the consonants and punctuation keys may be located anywhere on the keyboard. The alphabet is always in its natural sequential order. Color can be used as an identifying aid. These keyboards are intended for nontypists and physically handicapped people. All of the keyboards for homes are self-teaching. Typing lessons are not needed to find the desired keys.

3 Claims, 3 Drawing Sheets

KEYBOARDS FOR HOMES

This application is a continuation of Application Ser. No. 06/589,412, field Mar. 14, 1984 aband.

FIELD OF THE INVENTION

This invention relates to keyboards for use in the home, and specifically to new construction of the alphabet in a variety of designs.

BACK GROUND OF THE INVENTION

The first patent recorded for a typewriter was granted to Henry Mill, a London engineer, on Jan. 7, 1714. The first patent of any consequence was issued by the U.S. Pat. Office in 1829 to William Austin Burt of Detroit. It resembled a soapbox, on one end of which was a face similar to that of a clock. A hand on the face indicated the amount of paper in the machine. It was possible to turn an arm on the top of the machine to the desired letter and by pressing, to print with the aid of an inked pad. Burt called it the Typographer and it marked the beginning of the typewriter as a practical writing instrument. In 1833 the first manual keyboard was patented to Xavier Projean of Marseille.

In 1843 Charles Thurber of Worcester, Mass. received a patent on a printing machine that was built around a wheel and with individual selected type, each of which was actuated by a push of the finger. In 1850, John B. Fairbank was granted a patent for a machine that he called a phonetic writer, the first typewriter with a continuous-roll paper feed. In the same year, Oliver T. Eddy of Baltimore patented a typewriter that featured a piano keyboard and used an inked ribbon rather than an inked roller.

The first typewriter to be marketed was designed by Christopher Latham Sholes in 1873. In time it was found that a mechanical problem developed in that the type bars clashed and the keys jammed if they were struck too closely in succession. To solve this problem he shuffled and reshuffled the keys to slow down the typing operation. As a result the letters of the alphabet on the keyboard are scrambled. The keyboard therefore is a disorganized unit. Anyone trying to find letters to type words with finds it to be a slow process and extremely difficult without training.

The nature of the disorganized, scrambled keyboard requires that a person must go to typing classes for at least a year and a half to try to find out where the keys are. Many long hours of rote, drill and timed writings are required to learn the keyboard. The keyboard is taught by assigning specific keys to each of the specific ten fingers. One must have ten fingers to learn and to operate the keyboard. People without ten fingers do not have a keyboard they can use. This invention provides keyboards for them.

The standard universal keyboard that is in use today is known as the Qwerty. The name is derived from the first six keys on the top row of letters on the keyboard. Since 1873, when Sholes designed the Qwerty keyboard, research and studies conducted have addressed a keyboard arranged to solve mechanical problems and to keep keys from jamming. These problems were solved with the invention of electricity, but the disorganized, scrambled nature of the keyboard remains difficult to use today.

Although Thomas Edison was granted the first electric typewriter patent in 1872, it was during the 1950's that electric typewriters came into widespread use throughout the world. The standard universal keyboards were used and needed in offices in the business world, and were a product of the Industrial Revolution machines along with the locomotive, the reaper, sewing machine and the refrigerator.

In more recent times we are experiencing the Computer Revolution and keyboards are finding a new market in homes where children , as well as adults, need and use them. Many of these adults had never seen a keyboard before they purchased their computer. Without training they have the same problem with the keyboards on computers as with the standard universal Qwerty Design Keyboards in trying to find the desired keys to type words with so that they can put their programs on the computer. In the Qwerty Keyboard Design, the entire alphabet is separated from the punctuation, as opposed to the keyboard designs of this invention wherein the vowels are separated from the consonants and placed on a different row, and vowels and punctuation appear on the same row completing one embodiment design shown below:

| QWERTY Design | The Invention |
|---|---|
| QWERTYUIOP1/4 | BCDFGHJKLMN |
| ASDFGHJKL:" | ";AEIOU,?. (Design Row) |
| ZXCVBNM,.? | PQRSTVWXYZ |

SUMMARY OF THE INVENTION

Accordingly, several objects of this invention are directed to keyboard arrangement of the vowels, consonants and punctuation to provide keyboards to meet the various physical needs, as well as language and grammer provisions. The keyboards are intended for people who have never seen a keyboard before purchasing their computer or typewriter (nontypists) and inexperienced; and for physically limited, blind and otherwise handicapped people. The keyboards of this invention are to be used in homes and are for people who are not going into commercial businesses. The keyboards of this invention do not replace the standard universal keyboard known as Qwerty (a name derived from the first six keys on the top row). The keyboards of this invention are intended to extend the keyboards on computers, typewriters, and other typographical equipment as a communication tool for those people who have not been trained on a Qwerty keyboard so that the above cited disadvantages and hardships associated with the standard scrambled universal keyboard and referred to in Einbinder Pat. 3,945,482 and Pat. 3,929,216 and X. Box Pat. 3,847,263 will be eliminated.

This invention combines mechanical typewriter keys with human operator needs and personal physical circumstances in a plurality of individual keyboard designs which utilize 26 letters of the English alphabet in a keyboard configuration of at least two rows and an unlimited number of keys. The vowels are separated from the consonants and placed on a different row; thereafter, vowels and punctuation appear on the same row completing one design. In certain embodiments all of the vowels are separated from the consonants and in others only certain vowels are separated from the consonants. The punctuation used in all of the keyboard designs has been selected from over fourteen such marks. At least one or more of those chosen is used in all sentences typed. They are: quotation mark; apostrophe;

colon; semicolon; comma; question mark; slash; and period. Key tops identify key labels which may contain either two punctuation marks that are the same or two punctuation marks that are different. The selected punctuation marks are generally arranged in order of their appearance in a sentence. Usually the quotation mark is on the left, and as a sentence progresses the colon, semicolon and comma are most often used in the middle, and finally at the end of a sentence is either a question mark or a period. The alphabet letters are also in natural sequential order in each design. It is instantly apparent, therefore, that digital response is simultaneous, providing the nontypists instant access to the alphabet keys he is looking for to type the words and sentences he is creating and writing.

The general object of the invention is to provide keyboards to various kinds of needs that people have. For those who cannot leave their homes, using the keyboards of this invention will, as a result, assist many to find employment. These people may have physical limitation, such as less than two hands or ten fingers, but they can still accomplish their typing needs on any of these keyboards. Similarly, people with arthritis or other handicaps can work from their homes with keyboards of this invention. Special Education classes could help their students communicate by using these keyboard designs. Many blind people working in industry could advance their skills, and many more blind people would find these keyboards easy to operate and use.

The new invention will not require any change in the operating mechanism of the keyboard commonly being used on typewriters and computers and other typographical equipment. It can easily be accomplished on such keyboards by interchanging the type and key labels. Most typographical keyboards have four rows of 42 to 56 or more keys; a row for numbers and symbols and then three rows limited to the alphabet and punctuation marks. It is this area of rows of keys on which this invention places its Keyboards for Homes.

The invention is an improvement over alphabetical and other keyboards for the following unexpected results. The keyboards of -this invention are organized into language (alphabet) and grammer (punctuation) categories. Language, herein, is the systematic organization of the alphabet, and grammer is in the assembling of the punctuation marks used in every sentence typed. In each keyboard vowels are separated from the consonants and placed on a different row. In some of the keyboards of the invention all of the vowels are separated from the consonants and in others only certain vowels are separated from the consonants, and punctuation keys may be located elsewhere. The punctuation and vowels comprise one complete design on one row, which in one design would have the vowels in one group; some punctuation in a group(s); or a different keyboard alternates vowels with punctuation on one row. Another places one-half of the alphabet under the left hand and the other half of the alphabet under the right hand, with the punctuation marks being placed on the bottom row or any other location.

A further keyboard in this invention has the characters of the alphabet placed in their natural sequential order, horizontally, and includes punctuation on a three-row configuration. Additionally, a different keyboard is in the placement of the letters in a vertical alphabetic order on a three-row configuration including punctuation.

Separating the elements of language, vowels and consonants, and combining them with specific punctuation marks, produces a design row on the keyboard which is the invention on each one. Each keyboard becomes an organized unit and a field of visibility enables anyone immediate access to the letters he wants, to type with the keys he needs, to print words and sentences onto the page or onto his computer view screen.

This inventor is unaware of any keyboard that has heretofore been so organized and to benefit everyone desiring to type. Any person who can read by sight or by Braille can operate and use the keyboards of this invention immediately and successfully without typing lessons or memorizing by rote-drill practices, where to find the keys they are looking for on the keyboard.

Additionally it is known that Sholes in 1873 had the keys in alphabetical order. However, he separated the entire alphabet from the punctuation marks as opposed to the keyboards of this invention which separates the vowels from the consonants and thereafter provides for punctuation on the row with the vowels. The punctuation can also be anywhere on the keyboards of this invention.

| QWERTY Design | Alternate Keyboard of This Invention |
|---|---|
| QWERTYUIOP1/4 | ABCDEFGHJKLM |
| ASDFGHJKL:" | NPQRSTVWXYZ |
| ZXCVBNM,.? | ";IOU,?. (Design Row) |

Another object of the invention is to provide Visual Aid Charts with each different keyboard for use in touch typing. The only items needed are a typing book from the library and a kitchen timer from the hardware store for five minute timed writings. This is an additional feature, and not a requirement, of the keyboard designs of this invention. The Visual Aid Chart can also be used in business school classrooms for Touch Typing instruction. This invention is not intended to replace any known keyboard. It is intended to extend the use of the typewriter and computer keyboards as a communication tool to those people who are without a keyboard they can operate.

Color may be used as an identifying aid as follows: All the keys are gray, beige or black or any one color. Character designations on key tops are white; or, designations may be blue for vowels, green for punctuation marks or they can be of a different color. Also, keys may be gray for consonants; blue for vowels; green for punctuation with all of the designations being white.

The invention will be more fully understood from the following detailed description taken in conjunction with the accompanying drawings, in which.

DETAILED DESCRIPTION OF THE INVENTION

The invention will be described as embodied in more than one keyboard, each having its own particular design row. The parts of each keyboard are: the design row (vowels and punctuation); consonants, figures, symbols and color.

Figure 1A:
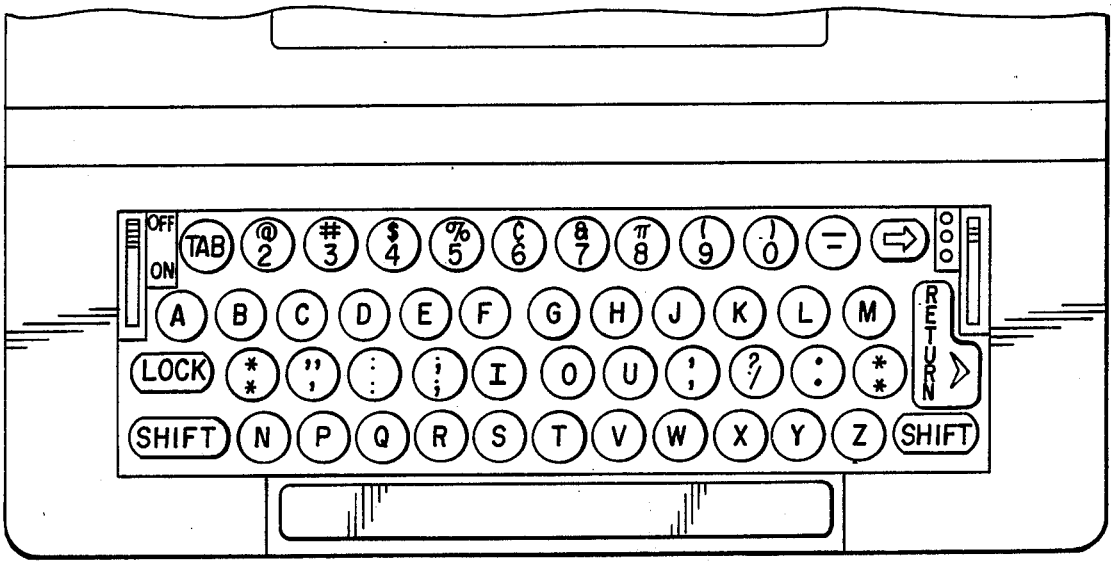
FIG. 1A is a schematic display of an embodiment of this invention using a 3-vowel and punctuation row.
Figure 1B:
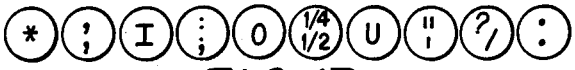
FIG. 1B is a schematic display of an alternate 3-vowel with punctuation row design.
Figure 1C:
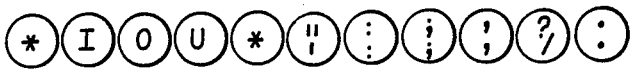
FIG. 1C is a schematic display of yet another alternate 3vowel with punctuation design.

Referring to FIGS. 1A–C, the vowels IOU are separated from the alphabet which is placed on any two rows; either the top, center or bottom. This is a 3-vowel design.

Punctuation marks that are most often used are: quotation mark, colon, semicolon, comma, question mark and period and are selected from over fourteen such marks.

The vowels IOU and punctuation marks are a design on one row. Preferably the IOU is in the middle of the row, and to the left is a blank key (shown as *), quotation mark, colon, semicolon, the vowels followed by a comma, a question mark, a period, and a blank key. Blank keys are on both sides of this vowel/punctuation design for one row. The purpose of the blank keys is for cosmetic purposes to keep from crowding visibility. However, if a blank key space was needed for a computer indication the space could be made available. The vowel/punctuation design row may be placed on either the top, middle or bottom rows, depending on what rows the consonants/alphabet are on.

The IOU vowel/punctuation design row may feature all of the vowels "IOU"on one-half of the row and all of the punctuation marks on the other half of the IOU design row, as in FIG. 1B.

Alternating vowels with punctuation as in FIG. 1C on the 3vowel IOU vowel/punctuation design row presents a semi-scrambled view to the operator. It should, however, be included here because some people work better in a less organized area. A blank key may be substituted for a different key.

A fraction symbol appears in the alternating design of FIG. 1B; symbols, however, are easily typed by using number figures and the slash mark and are therefore not mandatory in the design.

Figure 2A:
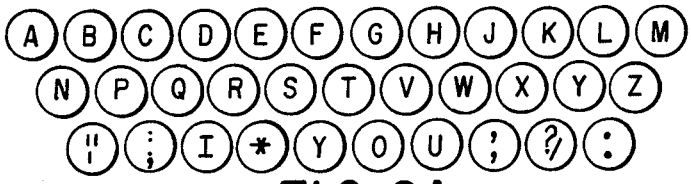
FIG. 2A is a schematic representation of another embodiment of this invention using a 4-vowel punctuation row.
Figure 2B:
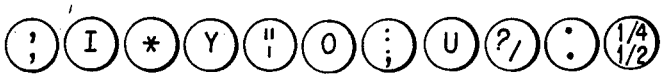
FIG. 2B is a schematic display of an alternate design for a 4-vowel with punctuation row.
Figure 2C:
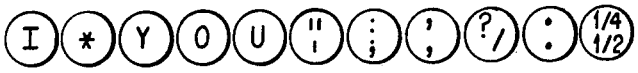
FIG. 2C is a schematic display of yet another alternate design of a 4-vowel with punctuation row.

FIGS. 2A–C use a 4-vowel design row, I*YOU which identify two words "I"and "YOU"and are easy for the typist to remember on the keyboard. They are separated from the alphabet which is placed on any two rows; either the top, center or bottom rows.

Punctuation marks that are most often used are: quotation mark, colon, semicolon, comma, question mark and period and are selected from over fourteen such marks.

The vowels I*YOU and punctuation marks are a design on one row. Preferably the I*YOU is in the middle of the row, as in FIG. 2A, and to the left is the quotation mark, colon, semicolon. The vowel design I*YOU is followed by the comma, question mark and period. If space is needed, the colon and semicolon may appear on one key instead of two keys. The I*YOU vowel/punctuation design row may feature all of the vowels 'I*YOU' on one-half of the row and all of the punctuation marks on the other half of the row. Preferably the punctuation would be to the right as in FIG. 2C. The asterisk may be part of the 4 vowel/punctuation design row.

FIG. 2B view shows alternating vowels with punctuation on the 4-vowel/punctuation design row, and presents a semi-scrambled view to the operator typist which crowds visibility. It should, however, be included here because some people work better in a less organized area. The blank key space (*) in this alternate design row may be substituted for a different key. A fraction symbol also appears in the alternating design. Symbols, however, are easily typed by using any number figure and the slash mark and are therefore not mandatory in this design.

Figure 3:
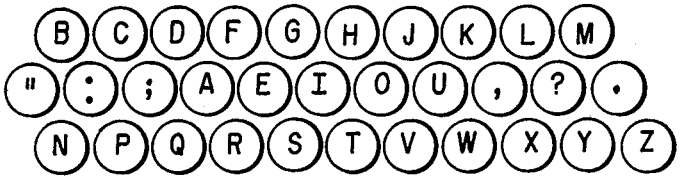
FIG. 3 is a schematic display of another embodiment of this invention using a 5-vowel with punctuation row.

In FIG. 3 a 5-vowel/punctuation design row appears on any one row and the consonants are on any two rows. The design row may be on top, center or bottom. The 5-vowel/punctuation row includes specific required punctuation marks as follows: quotation mark, colon, semicolon, the vowels AEIOU followed by comma, question mark, and period. Double punctuation may be on each punctuation key label. This is useful to handicapped people who may find using the shift key difficult, they can type in ALL CAPS and the punctuation marks will be the same on the upper and lower cases.

Figure 4A:
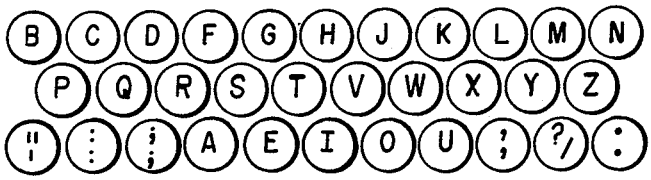
FIG. 4A is a schematic display similar to FIG. 3 illustrating a shift key for punctuation.
Figure 4B:
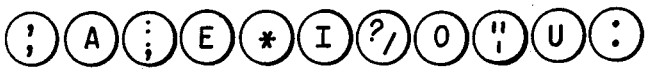
FIG. 4B is a view similar to FIG. 4A of an alternate design for a 5-vowel with punctuation row.

FIGS. 4A-B show a 5-vowel/punctuation design row with double punctuation on each such key. The five vowels, AEIOU, are separated from the consonants. The consonants are on different rows from the vowels. Thereafter vowels and specific punctuation marks appear on one row referred to as the design row. The vowels and the specific punctuation marks in this design are as follows: quotation mark, colon, semicolon, followed by the vowels AEIOU followed by comma, question mark, and period. Two punctuation marks on one key label would be as follows: quote and apostrophe; colon and colon; semicolon and semicolon followed by the vowels AEIOU and followed by comma and comma; question mark and slash; period and period. The vowels and punctuation marks in this keyboard design row cannot be substituted or alternated.

In the alternating arrangement of FIG. 4B the 5vowel/punctuation design row, the vowels and punctuation on the upper and lower key labels are alternated as follows: comma and comma; the vowel A; and colon and apostrophe; the vowel E and the asterisk; the vowel I and question mark and slash mark; the vowel 0 and quote, apostrophe; and the vowel U and the period and period. The use of asterisk in this design indicates that a blank key may be substituted for a different punctuation mark.

Figure 5:
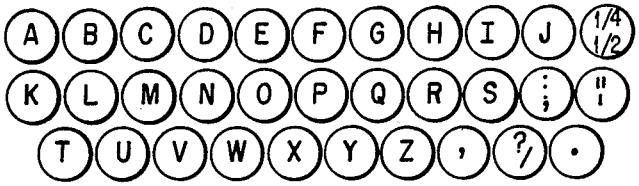
FIG. 5 is a schematic display wherein the letters run horizontally.

FIG. 5 shows the alternate arrangement of a horizontal alphabet of each of the letters A through J and a fraction one-half, one-fourth is added. These appear on the top row. On the center row is K through S and two punctuation keys which are: colon and semicolon; quotation mark and apostrophe. The letters T through Z followed by the comma, the question mark and slash and a key with a period are on the bottom row. The alphabet and punctuation keys in this design of the invention may not be substituted or alternated.

Figure 6:
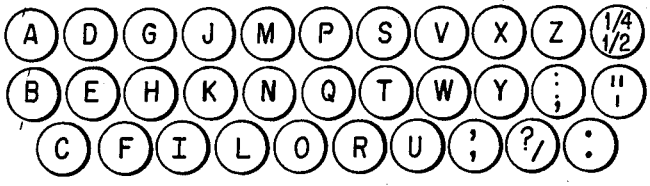
FIG. 6 is a schematic display wherein the letters run vertically.

FIG. 6 shows the alternate arrangement of a vertical alphabet of each of the letters reading per row across from left to right as follows: ABC; DEF; GHI; JKL; MNO; PQR; STU; VW and comma; XY and question mark and slash; Z and colon and semicolon; period; one fourth and one-half fraction mark; quotation mark and apostrophe mark. The alphabet and punctuation on keys in this design may not be substituted or alternated.

Figure 7:
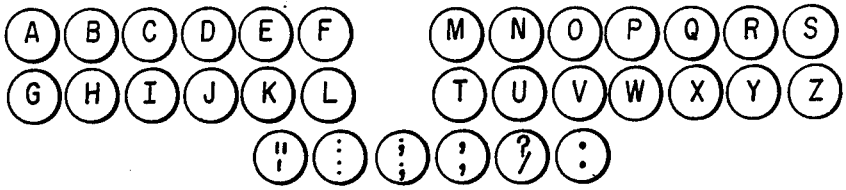
FIG. 7 is a schematic display wherein the letters are grouped for the left and the right hand.

FIG. 7 shows a keyboard design in which the 26 letters of the alphabet are divided in half to make 12 letters on the left and 14 letters on the right hand side. The letters are divided again to place six letters on the top row and six letters on the bottom row to the left hand side.

On the right hand side the 14 letters are divided in half to place 7 letters on the top right and 7 letters on the bottom right. The four quadrants are: upper left A through F and lower left G through L; upper right M through S and lower right T through Z. Punctuation marks on each key, upper and lower case are as follows: quotation mark and apostrophe; colon and colon; semicolon and semicolon; comma and comma; question mark and slash and period and period. Colon and semicolon can appear on one key to provide more space, otherwise the letters and punctuation may not be changed.

Figure 8:
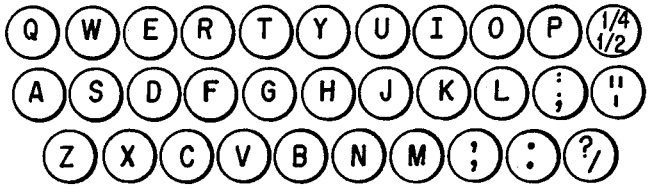
FIG. 8 PRIOR ART
FIG. 8 is a schematic display of the prior art keyboard design.

FIG. 8 is the keyboard of the prior art as follows: on the top row QWERTYUIOP ¼,½, and on the center row ASDFGHJKL:', and on the bottom row ZXCVBNM,.?

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. A keyboard display for use on typewriters and other typographical equipment having keys or key designations wherein three rows are provided with a top row of 10 keys, a center row of 11 keys, and a bottom row of 11 keys comprising:

Five vowels, A, E, I, O, U, displayed in alphabetical order on the center five keys of the center row and said center row further displaying on the outer three keys at each end all of the punctuation marks, provided on said keyboard, said punctuation marks including the quotation mark, colon, semicolon, comma, question mark, and period and said top and bottom rows displaying only the remaining letters of the alphabet in horizontal ascending alphabetical sequence starting at the left end of the top row.

2. The keyboard display of claim 1 in which the keys in the center row are arranged as follows:

": ; A E I O U ,? .

3. A keyboard display for use on typewriters and other typographical equipment having keys or key designations wherein three rows are provided with a top row of 10 keys, a center row of 11 keys, and a bottom row of 11 keys comprising:

said center row including five vowel keys and all punctuation marks contained on said keyboard, the keys in the center row being arranged as follows: ,A;E*I?/O,U;

said top and bottom rows displaying only the remaining letters of the alphabet in horizontal ascending alphabetical sequence starting at the left end of the top row.

* * * * *